US006162596A

United States Patent [19]

Schwark et al.

[11] Patent Number: 6,162,596

[45] Date of Patent: Dec. 19, 2000

[54] IMAGING ELEMENTS CONTAINING AN ELECTRICALLY-CONDUCTIVE LAYER COMPRISING POLYTHIOPHENE AND A CELLULOSIC POLYMER BINDER

[75] Inventors: Dwight W. Schwark; Debasis Majumdar, both of Rochester; Charles C. Anderson, Penfield; Robert J. Kress, Rochester, all of N.Y.

[73] Assignee: Eastman Kodak Company, Rochester, N.Y.

[21] Appl. No.: 09/386,523

[22] Filed: Aug. 30, 1999

[51] Int. Cl.[7] ..... G03C 1/89

[52] U.S. Cl. ..... 430/529; 430/527; 430/531

[58] Field of Search ..... 430/527, 529, 430/531

[56] References Cited

U.S. PATENT DOCUMENTS

| | | | |
|---|---|---|---|
| 2,271,234 | 1/1942 | Staud et al. | 430/510 |
| 2,327,828 | 8/1943 | Simmons . | |
| 2,801,191 | 7/1957 | Nadeau et al. | 430/527 |
| 4,070,189 | 1/1978 | Kelley et al. | 430/528 |
| 4,731,408 | 3/1988 | Jasne | 524/458 |
| 4,959,430 | 9/1990 | Jonas et al. | 526/257 |
| 4,987,042 | 1/1991 | Jonas et al. | 429/213 |
| 4,990,276 | 2/1991 | Bishop et al. | 252/62.54 |
| 5,035,926 | 7/1991 | Jonas et al. | 427/393.1 |
| 5,093,439 | 3/1992 | Epstein et al. | 525/540 |
| 5,254,446 | 10/1993 | Ikenoue et al. | 430/503 |
| 5,300,575 | 4/1994 | Jonas et al. | 525/186 |
| 5,300,676 | 4/1994 | Andree et al. | 560/56 |
| 5,312,681 | 5/1994 | Muys et al. | 430/527 |
| 5,354,613 | 10/1994 | Quintens et al. | 428/341 |
| 5,370,981 | 12/1994 | Krafft et al. | 430/527 |
| 5,372,924 | 12/1994 | Quintens et al. | 430/527 |
| 5,391,472 | 2/1995 | Muys et al. | 430/527 |
| 5,403,467 | 4/1995 | Jonas et al. | 205/125 |
| 5,463,056 | 10/1995 | Jonas | 544/350 |
| 5,575,898 | 11/1996 | Wolf et al. | 205/125 |
| 5,665,498 | 9/1997 | Savage et al. | 430/529 |
| 5,674,654 | 10/1997 | Zumbulyadis et al. | 430/536 |
| 5,679,505 | 10/1997 | Tingler et al. | 430/527 |
| 5,716,550 | 2/1998 | Gardner et al. | 252/500 |
| 5,718,995 | 2/1998 | Eichorst et al. | 430/531 |
| 5,747,412 | 5/1998 | Leenders et al. | 430/620 |

FOREIGN PATENT DOCUMENTS 0 459 349 A1 12/1991 European Pat. Off. .

OTHER PUBLICATIONS

Research Disclosure, Nov. 1992, Item 34390, "Photographic Light–Sensitive Silver Halide Film can Comprise a Transparent Magnetic Recording Layer, Usually Provided on the Backside of the Photographic Support".

*Primary Examiner*—Richard L. Schilling
*Attorney, Agent, or Firm*—Doreen M. Wells

[57] ABSTRACT

An imaging element comprising;

a support;

at least one image forming layer superposed on the support; and an electrically-conductive layer superposed on the support; said electrically-conductive layer comprising a substituted or unsubstituted thiophene-containing electrically-conductive polymer and a cellulosic polymer binder. Such an electrically-conductive layer provides protection against the accumulation of static electrical charges before and after image processing and provides improved physical properties.

11 Claims, No Drawings

IMAGING ELEMENTS CONTAINING AN ELECTRICALLY-CONDUCTIVE LAYER COMPRISING POLYTHIOPHENE AND A CELLULOSIC POLYMER BINDER

CROSS REFERENCE TO RELATED APPLICATIONS

This application relates to commonly assigned copending applications Ser. No. 09/386,526 pending, Ser. No. 09/386,115 pending, and Ser. No. 09/386,525 pending, all filed simultaneously herewith. These copending applications are incorporated by reference herein for all that they contain.

FIELD OF THE INVENTION

The present invention relates to imaging elements such as photographic, electrophotographic, and thermal imaging elements comprised of a support, at least one image forming layer and an electrically-conductive layer. More specifically, this invention relates to electrically-conductive layers containing a substituted or unsubstituted thiophene-containing electrically-conductive polymer and a cellulosic polymer binder.

BACKGROUND OF THE INVENTION

The problem of controlling static charge is well known in the field of photography. The accumulation of charge on film or paper surfaces leads to the attraction of dirt which can produce physical defects. The discharge of accumulated charge during or after the application of the sensitized emulsion layer(s) can produce irregular fog patterns or "static marks" in the emulsion. Static problems have been aggravated by increases in the sensitivity of new emulsions, increases in coating machine speeds, and increases in post-coating drying efficiency. The charge generated during the coating process may accumulate during winding and unwinding operations, during transport through the coating machines and during finishing operations such as slitting and spooling. Static charge can also be generated during the use of the finished photographic film product by both the customer and photofinisher. In an automatic camera, the winding of roll film in and out of the film cartridge, especially in a low relative humidity environment, can result in static charging. Similarly, high speed automated film processing can result in static charge generation. Sheet films (e.g., x-ray films) are especially susceptible to static charging during removal from light-tight packaging.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outermost coated layer either over the emulsion layers or on the side of the film base opposite to the emulsion layers or both. For some applications, the antistatic agent can be incorporated into the emulsion layers. Alternatively, the antistatic agent can be directly incorporated into the film base itself A wide variety of electrically-conductive materials can be incorporated into antistatic layers to produce a wide range of conductivities. These can be divided into two broad groups: (i) ionic conductors and (ii) electronic conductors.

Most of the traditional antistatic layers comprise ionic conductors. Thus, charge is transferred in ionic conductors by the bulk diffusion of charged species through an electrolyte. The prior art describes numerous simple inorganic salts, alkali metal salts of surfactants, ionic conductive polymers, polymeric electrolytes containing alkali metal salts, and colloidal metal oxide sols stabilized by metal salts. Conductivity of most ionically conductive antistatic agents is generally strongly dependent upon temperature and relative humidity of the environment as well as the moisture in the antistatic layer. Because of their water solubility, many simple ionic conductors are usually leached out of antistatic layers during processing, thereby lessening their effectiveness.

Antistatic layers employing electronic conductors have also been described in the art. Because the conductivity depends predominantly upon electronic mobilities rather than ionic mobilities, the observed electronic conductivity is independent of relative humidity and other environmental conditions. Such antistatic layers can contain high volume percentages of electronically conductive materials including metal oxides, doped metal oxides, conductive carbon particles or semi-conductive inorganic particles. While such materials are less affected by the environment, a lengthy milling process is often required to reduce the particle size range of oxides to a level that will provide a transparent antistatic coating needed in most imaging elements. Additionally, the resulting coatings are abrasive to finishing equipment given the high volume percentages of the electronically conductive materials.

Electrically-conductive polymers have recently received attention from various industries because of their electronic conductivity. Although many of these polymers are highly colored and are less suited for photographic applications, some of these electrically-conductive polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 4,731,408; 4,959,430; 4,987,042; 5,035,926; 5,300,575; 5,312,681; 5,354,613; 5,370,981; 5,372,924; 5,391,472; 5,403,467; 5,443,944; 5,463,056; 5,575,898; and 5,747,412) and substituted or unsubstituted aniline-containing polymers (as mentioned in U.S. Pat. Nos. 5,716,550 and 5,093,439) are transparent and not prohibitively colored, at least when coated in thin layers at moderate coverage. Because of their electronic conductivity instead of ionic conductivity, these polymers are conductive even at low humidity. Moreover, these polymers can retain sufficient conductivity even after wet chemical processing to provide what is known in the art as "process-surviving" antistatic characteristics to the photographic support they are applied onto. Unlike metal-containing semi-conductive particulate antistatic materials (e.g., antimony-doped tin oxide), the aforementioned electrically-conductive polymers are less abrasive, environmentally more acceptable (due to the absence of heavy metals), and, in general, less expensive.

However, it has been reported that the mechanical strength of a binderless antistat layer comprising substituted or unsubstituted thiophene-containing polymers is not sufficient and can be easily damaged unless a water-soluble or water-dispersible binder is used in the antistat layer (U.S. Pat. Nos. 5,300,575 and 5,354,613). Alternatively, the mechanical strength of an antistat layer comprising only substituted or unsubstituted thiophene-containing polymers can be improved by applying an overcoat layer of a film-forming polymeric material from either an organic solvent solution or an aqueous solution or dispersion (U.S. Pat. No. 5,370,981). A preferred polymeric material for use as an aqueous dispersible binder with such polythiophene containing antistatic layers, or as a protective overcoat layer on such polythiophene-containing antistatic layers is polymethyl methacrylate (U.S. Pat. Nos. 5,354,613 and 5,370,981). However, these binders or protective overcoat layers may be too brittle for certain applications, such as motion picture print films (as illustrated in U.S. Pat. No. 5,679,505).

Alternative polymeric materials for overcoats include cellulose derivatives, polyacrylates, polyurethanes, lacquer systems, polystyrene or copolymers of these materials (as discussed in U.S. Pat. No. 5,370,981). However, according to U.S. Pat. No. 5,370,981, the use of an alkoxysilane is required in either the binderless polythiophene containing antistatic layer, the overcoat layer, or both layers to provide layer adhesion in such a two layer structure.

A variety of water-soluble or water-dispersible polymeric binder materials have been used in polythiophene containing antistat layers. In addition to the aforementioned polymethylmethacrylate, water dispersible materials include hydrophobic polymers with a glass transition temperature (Tg) of at least 40° C. such as homopolymers or copolymers of styrene, vinylidene chloride, vinyl chloride, alkyl acrylates, alkyl methacylates, polyesters, urethane acrylates, acrylamide, and polyethers (as discussed in U.S. Pat. No. 5,354,613). Other water dispersible materials include polyvinylacetate (U.S. Pat. No. 5,300,575) or latex (co)polymers having hydrophilic functionality from groups such as sulphonic or carboxylic acid (U.S. Pat. No. 5,391,472). Water soluble binders include gelatin and polyvinylalcohol (U.S. Pat. No. 5,312,681). Polythiophene containing antistat layers, both in the presence and absence of water-soluble or water-dispersible polymeric binder materials, have been shown to tolerate the addition of water-miscible organic solvents (U.S. Pat. No. 5,300,575). However, the prior polythiophene antistat art only teaches the use of polythiophene in combination with water-soluble or water-dispersible polymeric binder materials prepared via solutions containing a minimum water content of approximately 37 wt % (as seen in U.S. Pat. No. 5,443,944, column 7, lines 1–17, magnetic and antistat layer 6.3 in Example 6).

Prior art for substituted or unsubstituted pyrrole-containing polymers (as mentioned in U.S. Pat. Nos. 5,665,498 and 5,674,654) describes the use of these materials dispersed in a film-forming binder. While a broad range of binders useful in antistatic layers is described, examples from these patents only teach the use of aqueous coatings containing polypyrrole and water-dispersible or water-soluble binders.

Prior art for substituted or unsubstituted aniline-containing polymers (as mentioned in U.S. Pat. No. 5,716,550) describes the use of these materials dissolved in a first solvent and a film-forming binder dissolved in a second different solvent. While the above art teaches the use of cellulosic film-forming binders with substituted or unsubstituted aniline-containing polymers, in order to prepare the antistat layer this art teaches the use of solvent systems such as chlorinated solvents, which are environmentally less friendly. In addition, examples from this art indicate a light green color even at coverages of the substituted or unsubstituted aniline-containing polymer as low as 0.01 g/m$^2$.

What is needed in the art is an imaging element comprised of an electrically-conductive antistatic layer that confers on the element process-surviving antistatic characteristics as well as resistance to abrasion and scratching and improved layer adhesion, without adding undesirable coloration to the imaging element.

SUMMARY OF THE INVENTION

The problems noted above are overcome with an imaging element comprising;

a support;

at least one image forming layer superposed on the support; and an electrically-conductive layer superposed on the support; said electrically-conductive layer comprising a substituted or unsubstituted thiophene-containing electrically-conductive polymer and a cellulosic polymer binder.

The present invention provides advantages over the known art. The electrically-conductive antistatic layers of the invention have many properties that are desirable in the manufacture of imaging elements. These include: a transparent, less abrasive, environmentally more acceptable antistatic layer; antistatic properties at low humidity; antistatic properties before and after image processing without the need for an additional barrier overcoat layer; and resistance to scratching and high humidity ferrotyping. The antistatic layer of the invention may also contain other additional compounds including surfactants, coating aids, matte particles, rheology modifiers, crosslinking agents, inorganic fillers such as metal oxide particles, pigments, magnetic particles, biocide, lubricants, and the like, depending upon the additional functions needed for the particular layer.

DETAILED DESCRIPTION OF THE INVENTION

The imaging elements of the present invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche, especially CRT-exposed autoreversal and computer output microfiche films. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, polyethylene films, polypropylene films, glass, metal, paper (both natural and synthetic), polymer-coated paper, and the like.

The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In order to promote adhesion between the conductive backing of this invention and the support, the support can be surface-treated by various processes including corona discharge, glow discharge, UV exposure, flame treatment, electron-beam treatment, as described in U.S. Pat. No. 5,718,995 or treatment with adhesion-promoting agents including dichloro- and trichloro-acetic acid, phenol derivatives such as resorcinol and p-chloro-m-cresol, solvent washing or overcoating with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like.

Further details with respect to the composition and function of a wide variety of different imaging elements are provided in U.S. Pat. No. 5,300,676 and references described therein which are incorporated herein by reference. All of the imaging processes described in the '676 patent, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

The antistatic coating compositions employed for the practice of the invention can be applied to the aforementioned film or paper supports by any of a variety of well-known coating methods. Handcoating techniques include using a coating rod or knife or a doctor blade. Machine coating methods include skim pan/air knife coating, roller coating, gravure coating, curtain coating, bead coating or slide coating. Alternatively, the antistatic layer or layers of the present invention can be applied to a single or multilayered polymeric web by any of the aforementioned methods, and the said polymeric web can subsequently be laminated (either directly or after stretching) to a film or paper support of an imaging element (such as those discussed above) by extrusion, calendering or any other suitable method, with or without suitable adhesion promoting tie layers.

The antistatic layer or layers of the present invention can be applied to the support in various configurations depending upon the requirements of the specific application. As an abrasion resistant layer, the antistatic layer of the present invention is preferred to be an outermost layer, preferably on the side of the support opposite to the imaging layer. However, the layer of the present invention can be placed at any other location within the imaging element, to fulfill other objectives. In the case of photographic elements, an antistatic layer can be applied to a polyester film base during the support manufacturing process, after orientation of the cast resin, and on top of a polymeric undercoat layer. The antistatic layer can be applied as a subbing layer under the sensitized emulsion, on the side of the support opposite the emulsion or on both sides of the support. Alternatively, it can be applied over the imaging layers on either or both sides of the support, particularly for thermally-processed imaging element. When the antistatic layer is applied as a subbing layer under the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion. The present invention can be used in conjunction with an intermediate layer, containing primarily binder and antihalation dyes, that functions as an antihalation layer. Alternatively, these could be combined into a single layer. Detailed description of antihalation layers can be found in U.S. Pat. No. 5,679,505 and references therein which are incorporated herein by reference.

Typically, the antistatic layer may be used in a single or multilayer backing layer which is applied to the side of the support opposite to the sensitized emulsion. Such backing layers, which typically provide friction control and scratch, abrasion, and blocking resistance to imaging elements are commonly used, for example, in films for consumer imaging, motion picture imaging, business imaging, and others. In the case of backing layer applications, the antistatic layer can optionally be overcoated with an additional polymeric topcoat, such as a lubricant layer, and/or an alkali-removable carbon black-containing layer (as described in U.S. Pat. Nos. 2,271,234 and 2,327,828), for antihalation and camera- transport properties, and/or a transparent magnetic recording layer for information exchange, for example, and/or any other layer(s) for other functions.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive material, antihalation dye, and a binder. This hybrid layer can be coated on one side of a film support under the sensitized emulsion.

It is also contemplated that the electrically-conductive layer described herein can be used in imaging elements in which a relatively transparent layer containing magnetic particles dispersed in a binder is included. The electrically-conductive layer of this invention functions well in such a combination and gives excellent photographic results. Transparent magnetic layers are well known and are described, for example, in U.S. Pat. No. 4,990,276, European Patent 459,349, and Research Disclosure, Item 34390, November, 1992, the disclosures of which are incorporated herein by reference. As disclosed in these publications, the magnetic particles can be of any type available such as ferro- and ferri-magnetic oxides, complex oxides with other metals, ferrites, etc. and can assume known particulate shapes and sizes, may contain dopants, and may exhibit the pH values known in the art. The particles may be shell coated and may be applied over the range of typical laydown.

Imaging elements incorporating conductive layers of this invention that are useful for other specific applications such as color negative films, color reversal films, black-and-white films, color and black-and-white papers, electrophotographic media, thermal dye transfer recording media etc., can also be prepared by the procedures described hereinabove. Other addenda, such as polymer latices to improve dimensional stability, hardeners or crosslinking agents, and various other conventional additives can be present optionally in any or all of the layers of the various aforementioned imaging elements.

The antistatic layer of the present invention comprises an electrically-conductive polymer, specifically a substituted or unsubstituted thiophene-containing electrically-conductive polymer, and a cellulosic polymer binder, and can be coated out of a primarily solvent based system as part of an imaging element. Substituted or unsubstituted thiophene-containing polymers are described in U.S. Pat. Nos. 4,731,408; 4,959,430; 4,987,042; 5,035,926; 5,300,575; 5,312,681; 5,354,613; 5,370,981; 5,372,924; 5,391,472; 5,403,467; 5,443,944; 5,463,056; 5,575,898; and 5,747,412. Typically a polyanion is used with the electrically-conductive substituted or unsubstituted thiophene-containing polymer. Polyanions of polymeric carboxylic acids or of polymeric sulfonic acids are described in U.S. Pat. No. 5,354,613. The relative amount of the polyanion component to the substituted or unsubstituted thiophene-containing polymer may vary from 85/15 to 50/50. The polymeric sulfonic acids are those preferred for this invention. The molecular weight of the polyacids providing the polyanions is preferably between 1,000 and 2,000,000, and is more preferably between 2,000 and 500,000. The polyacids or their alkali salts are commonly available, e.g., polystyrenesulfonic acids and polyacrylic acids, or they may be produced based on known methods. Instead of the free acids required for the formation of the electrically-conductive polymers and polyanions, mixtures of alkali salts of polyacids and appropriate amounts of monoacids may also be used. The electrically-conductive polymer and polyanion compound may be soluble or dispersible in water or organic solvents or mixtures thereof. The preferred electrically-conductive polymer for the present invention is a substituted thiophene-containing polymer known as poly(3,4-ethylene dioxythiophene styrene sulfonate).

A second component of the antistatic layer is a cellulosic material. Examples of cellulosic materials that can be used for the present invention include cellulose esters and cellulose ethers. Useful cellulose esters include cellulose acetate, cellulose acetate butyrate, cellulose acetate propionate, cellulose acetate phthalate, cellulose acetate trimellitate, and cellulose nitrate, while useful cellulose ethers include methyl cellulose, carboxymethyl cellulose, ethyl cellulose, hydroxymethyl cellulose, hydroxyethyl cellulose, hydroxypropyl cellulose, and hydroxypropyl methylcellulose. The above list of cellulosic materials is only representative and is not meant to be limiting in any way. Blends of cellulosic materials are also useful. The preferred cellulosic binder for the present invention is one which is soluble in a common organic solvent system including minimal amounts of water. Such a preferred cellulosic material is a cellulose ester and most preferred is cellulose diacetate.

U.S. Pat. Nos. 5,665,498 and 5,674,654 describe the use of a dispersion of poly(3,4-ethylene dioxypyrrole/styrene sulfonate) or polypyrrole/poly(styrene sulfonic acid) in a film-forming binder. A wide variety of useful binders in antistatic layers are mentioned in these patents. However, neither of these patents teaches the use of cellulosic binders with electrically-conductive polymers as antistatic layers nor is their use anticipated based on the aqueous coating compositions containing water-soluble or water-dispersible binders disclosed in these patents.

U.S. Pat. No. 5,354,613 describes the use of a polythiophene with conjugated polymer backbone in the presence of a polymeric polyanion compound and a hydrophobic organic polymer having a glass transition value (Tg) of at least 40° C. However, this patent never teaches the use of cellulosic materials as the hydrophobic organic polymer with the polythiophene and polymeric polyanion. Also, the use of a cellulosic material as a binder in the polythiophene antistatic layer of the present invention is not anticipated because U.S. Pat. No. 5,354,613 only teaches the use of an aqueous dispersion of the hydrophobic organic polymer in a primarily aqueous coating composition.

U.S. Pat. No. 5,716,550 describes an electrically-conductive coating composition comprising a solution of a complex of a polymeric polyaniline and a protonic acid dissolved in a first solvent having a Hansen polar solubility parameter of from 13 to about 17 $MPa^{1/2}$ and a Hansen hydrogen bonding solubility parameter of from about 5 to about 14 $MPa^{1/2}$, and a film-forming binder dissolved in a second solvent. As a solvent for the film-forming binder, this patent teaches the use of either water, a chlorinated solvent, or a mixture of a chlorinated solvent with a lower alcohol or acetone. Examples of the coating compositions from this patent teach the use of non-environmentally friendly solvent systems such as dichloromethane either by itself or in combination with methanol or acetone to dissolve a cellulosic film-forming binder. When coated as an antistatic layer, the coating compositions of U.S. Pat. No. 5,716,550 employing cellulosic film-forming binders result in layers with a green coloration.

As will be seen in the working examples of the present invention, electrically-conductive antistatic layers comprising a substituted or unsubstituted thiophene-containing electrically-conductive polymer and a cellulosic polymer binder can be prepared from coating compositions wherein the solvent for the cellulosic film-forming binder is a more environmentally friendly solvent such as acetone. The use of chlorinated solvents is not required for the present invention. In addition, the electrically-conductive polymer, a substituted or unsubstituted thiophene-containing polymer, can first be prepared in a simple, more environmentally friendly solvent mixture of methanol and water in the present invention. Examples of the present invention utilize a solvent mixture of methanol and water with weight percents of 76 and 24, respectively, for first preparing the poly(3,4-ethylene dioxythiophene styrene sulfonate). Such a solvent system has a Hansen polar solubility parameter of 13.0 $MPa^{1/2}$ and a Hansen hydrogen bonding solubility parameter of 26.3 $MPa^{1/2}$ and therefore lies outside of the range taught in U.S. Pat. No. 5,716,550 for the polyaniline-protonic acid complex. Also, the electrically-conductive antistatic layers of the present invention, comprising a substituted or unsubstituted thiophene-containing electrically-conductive polymer and a cellulosic polymer binder, provide essentially colorless layers and are therefore preferred for imaging elements.

As will be seen in the comparative example of the present invention and in the following prior art for electrically-conductive polymers and binders as antistatic layers, not all of the useful binders in antistatic layers described in U.S. Pat. Nos. 5,665,498; 5,674,654; 5,354,613; and 5,716,550 can function as the binder with the electrically-conductive substituted or unsubstituted thiophene-containing polymer of the present invention. For example, U.S. Pat. application Ser. No. 09/276,196 describes the use of an electrically-conductive layer containing a modified gelatin binder and an electrically-conductive polymer such as the substituted or unsubstituted thiophene-containing electrically-conductive polymer claimed in the present invention. While gelatin is described as a useful binder in antistatic layers in U.S. Pat. Nos. 5,665,498; 5,674,654; and 5,716,550; only the modified gelatin binder of U.S. Pat. application Ser. No. 09/276,196, where the modified gelatin is a graft copolymer of gelatin and a vinyl polymer having acid functionality, in combination with the electrically-conductive polymer can provide sufficient conductivity to the antistatic layer. Similarly, while Example 13 in U.S. Pat. No. 5,300,575, column 16, lines 6–32, shows that a particular polyurethane dispersion can function as a binder for an electrically-conductive poly(3,4-ethylenedioxythiophene styrene sulfonic acid) material, Example 6 in U.S. Pat. No. 5,443,944, column 7, lines 1–17 and 55–68, shows that another polyurethane binding agent in the presence of the same electrically-conductive polymer does not provide sufficient antistatic effects. Thus, the examples of the present invention and the prior art for substituted or unsubstituted thiophene-containing electrically-conductive polymers in antistatic layers indicate that it is not obvious that all commonly used antistatic layer binders will work with substituted or unsubstituted thiophene-containing electrically-conductive polymers to form antistatic layers useful in imaging elements.

The cellulosic binder can be optionally crosslinked or hardened by adding a crosslinking agent that reacts with functional groups present in the cellulosic polymer, such as hydroxyl or carboxylic acid groups. Crosslinking agents, such as polyfunctional aziridines, carbodiimides, epoxy compounds, polyisocyanates, methoxyalkyl melamines, triazines, and the like are suitable for this purpose.

Any of the solvents customarily used in coating compositions may be satisfactorily used. These may include water, organic solvents, and their mixtures. However, the preferred organic solvents for the practice of the present invention may include, for example, acetone, methyl ethyl ketone, methanol, ethanol, butanol, Dowanol™ PM (1-methoxy-2-propanol or propylene glycol monomethyl ether), isopropanol, propanol, toluene, xylene, methyl isobutyl ketone, n-propyl acetate, cyclohexane and their mixtures. Among all the organic solvents, acetone, methanol, ethanol, isopropanol, Dowanol™ PM, butanol, propanol, cyclohexane, n-propyl acetate and their mixtures are most preferred.

The relative amount of the electrically-conductive substituted or unsubstituted thiophene-containing polymer can vary from 0.1–99 weight % and the relative amount of the cellulosic binder can vary from 99.9–1 weight % in the dried layer. In a preferred embodiment of this invention, the amount of electrically-conductive substituted or unsubstituted thiophene-containing polymer should be 2–70 weight % and the cellulosic binder should be 98–30 weight % in the dried layer.

In addition to binders, other components that are well known in the photographic art may also be present in the electrically-conductive layer. These additional components include: surfactants and coating aids, dispersing aids, thickeners, coalescing aids, soluble and/or solid particle dyes, antifoggants, biocides, matte particles, lubricants, pigments, magnetic particles, and others.

The coating composition employed for the practice of the present invention is preferably coated to yield an antistatic layer with a dry coverage of between 0.005 and 10 g/m$^2$, but most preferably between 0.01 and 2 g/m$^2$.

The present invention is further illustrated by the following examples of its practice. However, the scope of this invention is by no means restricted to these specific examples.

EXAMPLES

Sample Preparation

Electrically-conductive Polymer

The electrically-conductive polymer in the following examples is a polythiophene derivative. It is a commercially available aqueous solution (1.22 weight percent solids) of a substituted thiophene-containing polymer supplied by Bayer Corporation as Baytron™ P. This electrically-conductive polymer is based on an ethylene dioxythiophene in the presence of styrene sulfonic acid, henceforth referred to as EDOT.

Ionically-conductive Polymer (comparative)

The ionically-conductive polymer particle in the following comparative example is poly(N-vinylbenzyl-N,N,N-trimethylammonium chloride-co-ethylene glycol dimethacrylate) (93:7), as described in U.S. Pat. No. 4,070,189, and is henceforth referred to as VAEG (93:7). It is prepared by emulsion polymerization of chloromethylstyrene with ethylene glycol dimethacrylate to form a latex. The resultant vinyl benzyl halide latex was then reacted with a tertiary amine to form a conductive polymeric microgel before transferred to a relatively hydrophilic solvent such as methanol.

Cellulosic Polymer Binders

The cellulosic polymer binders in the following examples of the present invention consist of a variety of cellulose esters. These include cellulose acetate, cellulose acetate propionate, and cellulose nitrate. CA398-3 and CA320S are cellulose acetate, while CAP504-0.2 is cellulose acetate propionate, and all are supplied by Eastman Chemical Company. CN40-60 is cellulose nitrate and is supplied by Societe Nationale Powders and Explosives.

Comparative Polymer Binder

An alternative polymer binder in the following comparative example is polymethylmethacrylate. The polymethylmethacrylate material is Elvacite™ 2041 and is supplied by ICI Acrylics, Inc.

Coating Compositions and Application to Film Base

Antistatic layer coating solutions of the EDOT with or without the cellulose ester or comparative Elvacite™ 2041 binders were prepared in an acetone/alcohol (methanol or methanol/ethanol)/water solvent mixture with weight percentages of approximately 65, 27, and 8, respectively. The EDOT can first be mixed with methanol and then added to an additional solvent system either with or without a binder present in the solvent system. The antistatic layer coating solution of the VAEG (93:7) with a cellulose ester binder was prepared in an acetone/methanol solvent mixture as described in U.S. Pat. No. 4,070,189. The proportions of the conductive polymer and polymer binder are given in the following Tables. In addition, a 3 wt % overcoat solution of CA398-3 in an acetone/methanol solvent mixture was also prepared. The antistatic layer coating solutions were then applied to a cellulose triacetate support and dried at 125° C. for one minute to give transparent films with dry coating weights as shown in the following Tables. In some examples, the overcoat solution was then applied over the underlying antistatic layer and dried under similar conditions to yield an overcoat with a dry coating weight of 0.65 g/m$^2$.

TEST METHODS

Resistivity Testing

The surface electrical resistivity (SER) of the example antistatic layer coatings was measured at 50% RH and 72° F. with a Kiethley Model 616 digital electrometer using a two point DC probe method similar to that described in U.S.

Pat. No. 2,801,191. Internal resistivity or "water electrode resistivity" (WER) was measured by the procedures described in R. A. Elder, "Resistivity Measurements on Buried Conductive Layers", EOS/ESD Symposium Proceedings, September 1990, pages 251–254, for the overcoated antistatic layers. In some of the examples, SER was measured both prior to and after C-41 photographic processing of the example coatings to assess the "process survivability" of the antistatic layer.

Abrasion Resistance Testing

Dry abrasion resistance was evaluated by scratching the surface of the coating with a fingernail. The relative amount of coating debris generated is a qualitative measure of the dry abrasion resistance. Samples were rated either good, when no debris was seen, or poor, when debris was seen.

Working Examples

Examples 1–6 were prepared as per the present invention with either EDOT or VAEG (93:7) as the conductive polymer and various cellulose esters as the cellulosic binder or Elvacite™ 2041 as the comparative binder. Details about the dry coating composition and total nominal dry coverage of these samples and the corresponding SER values before and after C-41 photographic processing are provided in Table 1.

TABLE 1

| Coating | Conductive Polymer Dry wt % In Coating | Polymer Binder Dry wt % In Coating | Total Dry Coverage g/m$^2$ | SER log Ω/□ Before C-41 Processing | SER log Ω/□ After C-41 Processing |
|---|---|---|---|---|---|
| Example 1 (Comparative) | VAEG (93:7) 30 | CA398-3 70 | 0.23 | 8.4 | >13 |
| Example 2 (Invention) | EDOT 13 | CA398-3 87 | 0.16 | 6.9 | 7.9 |
| Example 3 (Invention) | EDOT 13 | CA320S 87 | 0.16 | 7.0 | 8.8 |
| Example 4 (Invention) | EDOT 13 | CAP504-0.2 87 | 0.16 | 6.4 | 9.0 |
| Example 5 (Invention) | EDOT 13 | CN40-60 87 | 0.16 | 7.7 | 9.2 |
| Example 6 (Comparative) | EDOT 13 | Elvacite ™ 2041 87 | 0.16 | 6.3 | 9.0 |

It is clear that all of the above examples prepared as per the present invention with EDOT as the electrically-conductive polymer and the various cellulosic binders, as seen in Examples 2–5, have excellent conductivity before and after C-41 processing and, thus, are effective as "process-surviving" antistatic layers which can be used as outermost layers without any protective topcoat to serve as a barrier layer. However, the same cellulosic binder with an ionically-conductive polymer, VAEG (93:7), does not provide a "process-surviving" antistatic layer with low resistivity, as seen in comparative Example 1, when present as an outermost layer without any protective topcoat. While comparative Example 6 can provide a "process-surviving" antistatic layer with low resistivity when present as an outermost layer without any protective topcoat, it displays a propensity to crack when the film is cut or punched with a hole punch. Such brittleness is a problem for certain applications, such as motion picture print films (as illustrated in U.S. Pat. No. 5,679,505). The preferred cellulosic binders, as seen in Examples 2–5, do not exhibit such cracking.

Examples 7–10 were prepared with EDOT as the conductive polymer either in the presence or absence of CA398-3 as the cellulosic binder. No overcoat is present for Examples 7 and 8, while an overcoat of CA398-3 is present in Examples 9 and 10. Details about the dry coating composition and total nominal dry coverage of the antistatic and overcoat layers are provided in Table 2. In addition, the corresponding SER and WER values before C-41 processing and performance in terms of the amount of coating removed during abrasion resistance testing are provided in Table 2.

TABLE 2

| Coating | Conductive Polymer Dry wt % In Coating | Cellulosic Binder Dry wt % In Coating | Antistat Total Dry Coverage g/m$^2$ | Overcoat Total Dry Coverage g/m$^2$ | SER log Ω /□ | WER log Ω /□ | Abrasion Resistance |
|---|---|---|---|---|---|---|---|
| Example 7 (Comparative) | EDOT 100 | None 0 | 0.02 | None 0 | 7.2 | | Poor |
| Example 8 (Invention) | EDOT 13 | CA398-3 87 | 0.16 | None 0 | 7.3 | | Good |
| Example 9 (Comparative) | EDOT 100 | None 0 | 0.02 | CA398-3 0.65 | | 6.1 | Good |
| Example 10 (Invention) | EDOT 13 | CA398-3 87 | 0.16 | CA398-3 0.65 | | 6.3 | Good |

It is clear that both of the above examples (Examples 8 and 10) prepared as per the present invention, with EDOT as the electrically-conductive polymer and a cellulosic binder, have excellent conductivity and abrasion resistance, either when used as an outermost layer (Example 8) or when overcoated with a protective topcoat (Example 10). However, when the electrically-conductive polymer EDOT is used without a cellulosic binder as an outermost layer there is a compromise in the abrasion resistance, as seen in comparative Example 7. As discussed in U.S. Pat. No. 5,354,613, an outermost layer of EDOT without a binder will also be prone to sticking to a normally hardened gelatin-silver halide emulsion layer at high relative humidity. Addition of the cellulosic binder improves the abrasion resistance but does not degrade the conductivity, as is evident when Example 8 is compared with Example 7. While the previous polythiophene patent literature (see for example U.S. Pat. No. 5,300,575) teaches overcoating a binderless polythiophene antistat layer with a cellulosic material to improve abrasion resistance (as seen in Table 3 when Example 9 is compared with Example 7), Example 8 from the present invention shows that this is not necessary. However, if an additional overcoat is desired, Example 10 of the present invention indicates that doing so does not degrade either the conductivity or abrasion resistance, when compared with the case of a binderless polythiophene antistat layer, as seen for Example 9.

The invention has been described in detail with particular reference to certain preferred embodiments thereof, but it will be understood that variations and modifications can be effected within the spirit and scope of the invention.

What is claimed is:

1. An imaging element comprising;

a support;

at least one image forming layer superposed on the support; and an electrically-conductive layer superposed on the support; said electrically-conductive layer comprising a substituted or unsubstituted thiophene-containing electrically-conductive polymer and a cellulosic polymer binder selected from the group consisting of cellulose esters and cellulose ethers.

2. The imaging element of claim 1 wherein the electrically-conductive layer has a dry coverage of between 0.005 and $10g/m^2$.

3. The imaging element of claim 1 wherein the cellulosic polymer binder is cellulose diacetate.

4. The imaging element of claim 1 wherein the electrically-conductive polymer is poly(3,4-ethylene dioxythiophene styrene sulfonate).

5. The imaging element of claim 1 wherein the amount of electrically-conductive polymer is from 0.1 to 99 weight percent of the electrically-conductive layer.

6. The imaging element of claim 1 wherein the amount of electrically-conductive polymer is between 2 and 70 weight percent of the electrically-conductive layer.

7. The imaging element of claim 1 wherein the amount of cellulosic polymer binder is 99.9 to 1.0 weight percent of the electrically-conductive layer.

8. The imaging element of claim 1 wherein the amount of cellulosic polymer binder is 98 to 30 weight percent of the electrically-conductive layer.

9. The imaging element of claim 1 further comprising addenda selected from the group consisting of surfactants, coating aids, dispersing aids, thickeners, coalescing aids, crosslinking agents or hardeners, soluble particle dyes, solid particle dyes, antifoggants, biocides, matte particles, lubricants, pigments and magnetic particles.

10. The imaging element of claim 1 wherein the element is photographic.

11. The imaging element of claim 10 wherein the image forming layer is light sensitive and comprises silver halide.

* * * * *